US010952579B2

(12) United States Patent
Knight Adams et al.

(10) Patent No.: US 10,952,579 B2
(45) Date of Patent: Mar. 23, 2021

(54) CLEANING HEAD FOR A VACUUM CLEANER

(71) Applicant: GREY TECHNOLOGY LIMITED, Warndon (GB)

(72) Inventors: Jack Knight Adams, Warndon (GB); Ross Exley, Warndon (GB)

( * ) Notice: Subject to any disclaimer, the term of this patent is extended or adjusted under 35 U.S.C. 154(b) by 174 days.

(21) Appl. No.: 16/337,704

(22) PCT Filed: Sep. 26, 2017

(86) PCT No.: PCT/GB2017/052867
§ 371 (c)(1),
(2) Date: Mar. 28, 2019

(87) PCT Pub. No.: WO2018/060684
PCT Pub. Date: Apr. 5, 2018

(65) Prior Publication Data

US 2020/0029761 A1 Jan. 30, 2020

(30) Foreign Application Priority Data

Sep. 30, 2016 (GB) ..... 1616598.7

(51) Int. Cl.
*A47L 9/04* (2006.01)
*A47L 5/24* (2006.01)

(52) U.S. Cl.
CPC ..... *A47L 9/0411* (2013.01); *A47L 5/24* (2013.01)

(58) Field of Classification Search
CPC ..... A47L 5/24; A47L 5/28; A47L 9/02; A47L 9/0411; A47L 9/24
See application file for complete search history.

(56) References Cited

U.S. PATENT DOCUMENTS 6,009,594 A 1/2000 Grey
6,055,701 A 5/2000 Grey et al.
(Continued)

FOREIGN PATENT DOCUMENTS

CA 2523614 A1 * 4/2006 ..... A47L 9/02
DE 10040776 A1 * 5/2001 ..... A47L 9/02
(Continued)

OTHER PUBLICATIONS

PCT International Search Report, PCT/GB2017/052867, Applicant: Grey Technology Limited, dated Feb. 1, 2018.
(Continued)

*Primary Examiner* — Marc Carlson
(74) *Attorney, Agent, or Firm* — Pedersen & Company, PLLC; Ken J. Pedersen; Barbara S. Pedersen

(57) ABSTRACT

The invention relates to a cleaning head (sometimes called a "suction head") for a vacuum cleaner, and in particular to a cleaning head having a motor to rotate a brush carried by the cleaning head. According to the invention there is provided a cleaning head (10) having a steering joint, the steering joint having a non-rotatable section (26) and a rotatable section (24) with a rotatable joint (20) between the non-rotatable section and the rotatable section. The cleaning head has a first holding region (52) which is engageable by a first part (50) of the rotatable section (24), the first holding region and the first part when engaged resisting rotation of the rotatable section. The cleaning head also has a second holding region (54) which is engageable by a second part (50) of the rotatable section (24), the second holding region and the second part when engaged resisting rotation of the rotatable section. The cleaning head can therefore be held against unwanted rotation in a storage position and also in a position in which it is suspended above a surface being cleaned.

19 Claims, 6 Drawing Sheets

(56) References Cited

U.S. PATENT DOCUMENTS

| | | | | |
|---|---|---|---|---|
| 6,101,668 | A | 8/2000 | Grey | |
| 6,243,912 | B1 | 6/2001 | Grey | |
| 6,949,130 | B1 | 9/2005 | Grey et al. | |
| 6,968,587 | B2 | 11/2005 | Grey | |
| 7,013,521 | B2 | 3/2006 | Grey | |
| 7,017,221 | B1 | 3/2006 | Grey et al. | |
| 7,117,556 | B2 | 10/2006 | Grey | |
| D554,814 | S | 11/2007 | Grey | |
| 7,331,078 | B2 | 2/2008 | Grey | |
| 7,334,284 | B2 | 2/2008 | Grey | |
| D568,008 | S | 4/2008 | Grey | |
| 7,802,343 | B2 | 9/2010 | Grey | |
| D694,481 | S | 11/2013 | Grey et al. | |
| 9,560,944 | B2 | 2/2017 | Grey | |
| 9,737,183 | B2 | 8/2017 | Grey | |
| 9,943,199 | B2 | 4/2018 | Grey et al. | |
| 2004/0074027 | A1 | 4/2004 | Grey | |
| 2005/0138764 | A1 | 6/2005 | Grey | |
| 2005/0204492 | A1 | 9/2005 | Grey | |
| 2006/0000040 | A1 | 1/2006 | Grey et al. | |
| 2008/0022485 | A1 | 1/2008 | Grey | |
| 2009/0300873 | A1 | 12/2009 | Grey | |
| 2010/0011534 | A1* | 1/2010 | Ashbee | A47L 9/02 15/415.1 |
| 2010/0229337 | A1* | 9/2010 | Conrad | A47L 5/28 15/415.1 |
| 2014/0033473 | A1 | 2/2014 | McVey | |
| 2016/0088987 | A1* | 3/2016 | Hwang | A47L 5/28 15/415.1 |
| 2016/0113457 | A1* | 4/2016 | Ji | A47L 9/009 15/354 |
| 2016/0157687 | A1* | 6/2016 | Perez | A47L 5/28 15/331 |
| 2017/0079493 | A1* | 3/2017 | Genn | A47L 9/009 |
| 2019/0029482 | A1 | 1/2019 | Grey et al. | |
| 2019/0208974 | A1* | 7/2019 | Oka | A47L 9/246 |
| 2020/0000304 | A1* | 1/2020 | Holmes | A47L 9/0477 |
| 2020/0221914 | A1* | 7/2020 | Kim | A47L 9/242 |
| 2020/0315414 | A1* | 10/2020 | Kovacs | A47L 9/009 |

FOREIGN PATENT DOCUMENTS

| | | | | |
|---|---|---|---|---|
| DE | 102015116074 | A1 | 3/2016 | |
| EP | 1136029 | A2 | 9/2001 | |
| EP | 3241475 | A2 * | 11/2017 | A47L 9/244 |
| FR | 2940034 | A1 * | 6/2010 | A47L 5/28 |
| JP | 2011120956 | A | 6/2011 | |
| JP | 2017158933 | A * | 9/2017 | A47L 9/24 |

OTHER PUBLICATIONS

PCT International Preliminary Report on Patentability, PCT/GB2017/052867, Applicant: Grey Technology Limited, Date of completion: Oct. 1, 2018.

* cited by examiner

Fig.4
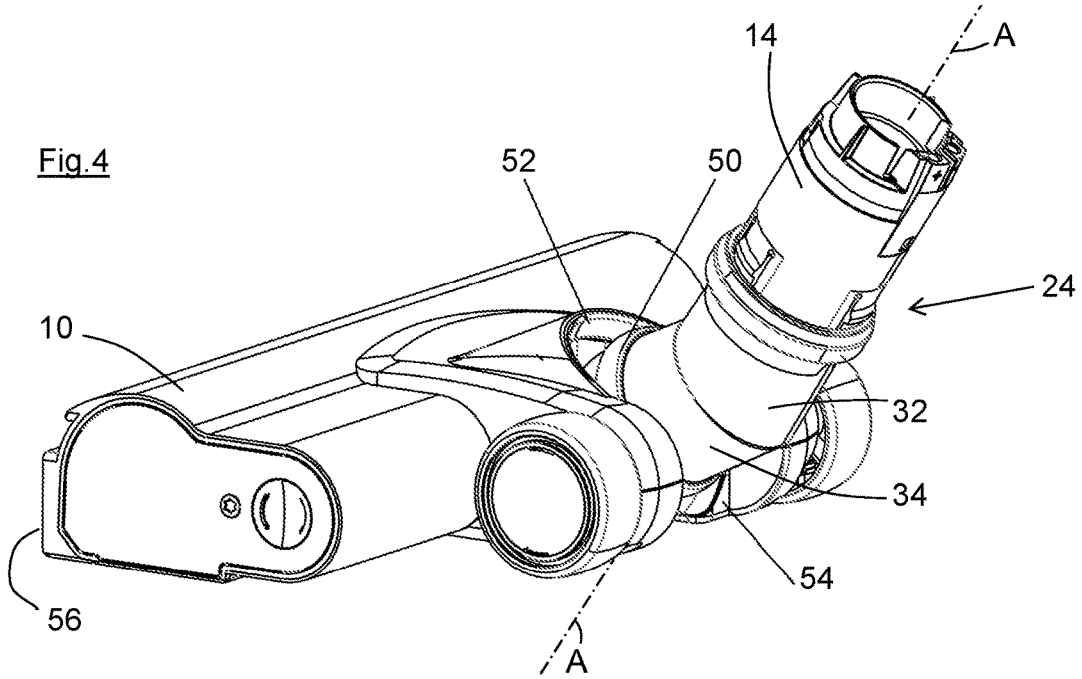
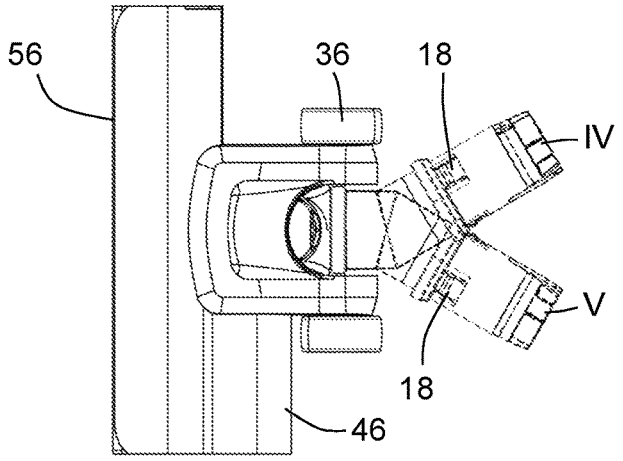
Fig.6
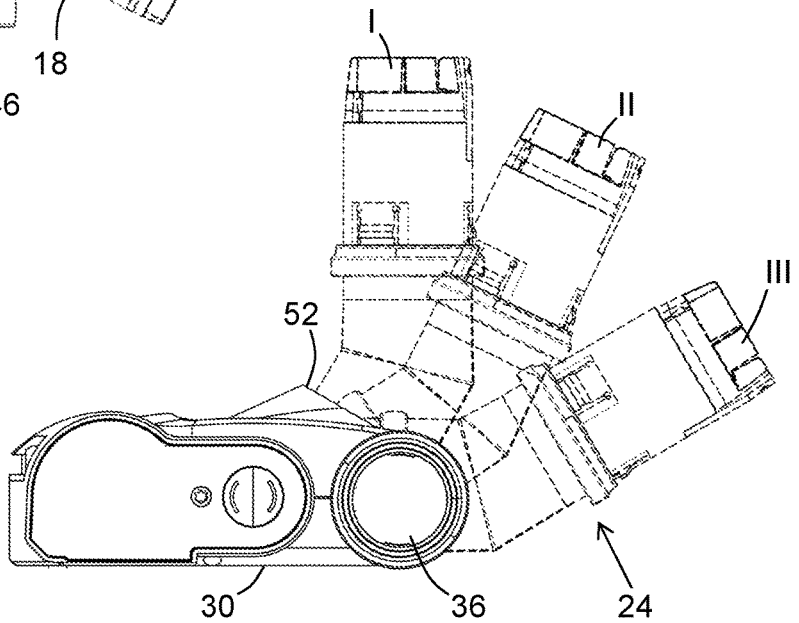
Fig.5

CLEANING HEAD FOR A VACUUM CLEANER

FIELD OF THE INVENTION

The invention relates to a cleaning head (sometimes called a "suction head") for a vacuum cleaner, and in particular to a cleaning head having a motor to rotate a brush carried by the cleaning head.

In the following description, directional and orientational terms such as "upper", "lower", "top" etc. refer to the cleaning head in its normal orientation of use upon a substantially horizontal surface, as represented in FIG. 1 and others. It will be understood, however, that the cleaning head can be used in other orientations.

BACKGROUND TO THE INVENTION

Most vacuum cleaners are fitted with a cleaning head through which air and entrained dirt and debris pass on their way to a dirt collection chamber. The cleaning head has a sole plate adapted to overlie or engage a surface to be cleaned, the sole plate having an opening through which the air and entrained dirt can pass. The dirt collection chamber will typically contain a removable vessel, perhaps comprising or containing a disposable bag, in which the dirt is collected for subsequent disposal.

Vacuum cleaners may be mains-powered or battery-powered and fall into three general classes. Upright vacuum cleaners have a cleaning head which is typically integrated into the body of the vacuum cleaner, the body of the vacuum cleaner containing the dirt collection chamber. Cylinder vacuum cleaners on the other hand have a cleaning head which is connected to the body of the vacuum cleaner by a length of flexible hose. With a cylinder vacuum cleaner the cleaning head can be moved across the surface being cleaned without necessarily also moving the body containing the dirt collection chamber.

Upright and cylinder vacuum cleaners are designed to rest upon the floor or ground during use, and are moved across the floor or ground by the user. The third general class of vacuum cleaner comprises hand-held vacuum cleaners which are adapted to be used whilst carried by the user. Most hand-held vacuum cleaners are battery-powered.

A particular type of hand-held vacuum cleaner is sometimes referred to as a "stick vacuum cleaner" and an example of a stick vacuum cleaner is shown in FIGS. 1-3. A stick vacuum cleaner has a body with a handle for gripping by the user. The body typically contains a battery, a motor, an impeller and a dirt-collection chamber. The body is connected to a cleaning head by a (substantially) rigid tube, the tube being sufficiently long to permit (for example) the cleaning head to be used for floor cleaning whilst the user is standing and carrying the body of the vacuum cleaner. The rigid tube and cleaning head are typically removable from the body to enable other cleaning operations.

The cleaning head of a cylinder vacuum cleaner is also typically connected to a (substantially) rigid tube which connects the flexible hose to the cleaning head. The rigid tube provides a handle part by which the user can move the cleaning head across the surface being cleaned, the rigid nature of the tube permitting the user to hold the handle part of the tube at a comfortable distance from the cleaning head (for example whilst standing and using a floor-engaging cleaning head).

It is a feature of the cleaning heads of stick vacuum cleaners and cylinder vacuum cleaners that they typically provide a steering joint allowing the cleaning head to be steered across a floor by the user. In practice, the cleaning head and rigid tube of a stick vacuum cleaner may be interchangeable with those components of a cylinder vacuum cleaner.

The present invention has been designed primarily for stick vacuum cleaners but is also applicable to cylinder vacuum cleaners (and may also be usable in other applications). For brevity, the following description will refer to stick vacuum cleaners unless otherwise indicated.

The cleaning head of a stick vacuum cleaner is adapted for floor cleaning, but may also be used for cleaning other (horizontal and non-horizontal) surfaces. To facilitate its use for floor cleaning, the cleaning head will typically be adjustable between a configuration for cleaning carpets, rugs and the like, and a configuration suited to cleaning hard floor surfaces such as wood, tiles etc. Additional tools are generally provided for cleaning of specific areas as and when required.

The cleaning head is typically removable (with or without the rigid tube), permitting the user to replace the cleaning head with a chosen additional tool. If the rigid tube is also removed the chosen additional tool may be connected directly to the body.

It is not typically necessary or desirable to utilise a steering joint for the additional tools, and so the steering joint is usually provided with the cleaning head. Accordingly, when the cleaning head is removed the steering joint is also removed.

It is desirable that the sole plate of the cleaning head can be maintained in contact with the floor as the position and orientation of the vacuum cleaner body changes during use. The cleaning head is therefore generally able to pivot relative to the rigid tube so that the sole plate can maintain a horizontal orientation (for example) as the body of the vacuum cleaner is raised and lowered during use.

Steering is achieved by rotating the body of the vacuum cleaner and thereby twisting the rigid tube. The steering joint has a non-rotatable section mounted to the body of the cleaning head and a rotatable section connected (or connectable) to the rigid tube. A rotatable joint permits relative rotation between these sections. The rotatable section is bent or angled at or above the rotatable joint and the combination of the rotatable joint and the angled rotatable section enables the steering joint to cause the cleaning head to change direction in response to twisting movements of the rigid tube. The steering mechanism or steering joint of a vacuum cleaner typically includes a rotatable joint and a pivotable joint such as those described in detail below, and in the following description the term "steering joint" describes a joint comprising a rotatable joint and a pivotable joint.

A steering joint is, however, often disadvantageous, particularly during periods of non-use of a stick vacuum cleaner (during which periods the body is not held by the user). A stick vacuum cleaner is usually stored in a generally upright position, with the cleaning head on the floor and the body leaning against a wall or the like. The vacuum cleaner is top heavy and relatively unstable in that position, and unless it is well balanced the steering joint will often permit the body to rotate relative to the cleaning head, and to slide across and down the wall. The significant weight of the body can cause damage to the wall, to the vacuum cleaner, and also to furniture and other items which are impacted by the body as it falls towards the floor.

Most users will be aware of this problem and during long term storage will usually wedge the body so that it cannot easily slide across and down the wall. However, such arrangements are often not available during short-term periods of non-use, for example whilst moving furniture or other items during a cleaning operation. During short-term periods of non-use a particularly diligent user may reach down and rest the body of the stick vacuum cleaner upon the floor, or otherwise place the body on a suitable surface so that it is stable. Other users may, however, lean the vacuum cleaner against a wall, and it is recognised that such usage will often result in the vacuum cleaner sliding across and down the wall with a significant possibility of damage.

The steering joint of the cleaning head of a cylinder vacuum cleaner presents similar problems in that the rigid tube and flexible tube are often leant against a wall during short-term periods of non-use. Whilst the steering joint makes the rigid tube and flexible tube unstable in such a position, their combined weight is significantly less than that of the body of a stick vacuum cleaner and the effect of the rigid tube and flexible hose sliding across and down the wall are generally less significant.

The general desire for a cleaning head to be substantially fixed in position when not in use has been recognised by the manufacturers of cylinder vacuum cleaners. Many of the cleaning heads of cylinder vacuum cleaners therefore have locking mechanisms permitting the cleaning head to be secured to the body of the cylinder vacuum cleaner when not in use, or to be secured in position relative to the rigid tube. In particular, the cleaning head of a cylinder vacuum cleaner will typically be stored against the body of the vacuum cleaner, often with a male/female clip element. Only the most diligent of users will typically use the clip element during short-term periods of non-use, however, and such an arrangement is not suitable for use with a stick vacuum cleaner.

To improve the cleaning efficiency of a vacuum cleaner, it is known to fit a rotating brush to the cleaning head, the brush projecting through the opening in the sole plate. The bristles of the brush engage the carpet or other floor surface and mechanically dislodge dirt and debris to assist the entrainment of that dirt and debris into the passing airflow. In many cleaning heads the brush is electrically operated, the cleaning head having a motor connected to the brush. In a stick vacuum cleaner the electrical power for the motor is communicated from the battery within the body by electrical wires passing along the rigid tube.

It is desirable that the rigid tube is connected approximately at the centre of the cleaning head, i.e. so that the cleaning head projects to the left and right (from a user's perspective) by approximately equal distances from the rigid tube. In order to avoid the motor obstructing the airflow path through the cleaning head the motor is typically offset from the centreline. The motor is usually the heaviest component of the cleaning head and its location offset from the centreline causes the centre of gravity of the cleaning head also to be offset from the centreline, and in particular to be offset from the rotation axis of the rotatable joint. The offset weight is not a significant concern whilst the vacuum cleaner is in use upon a floor or other substantially horizontal surface, but when the cleaning head is lifted from the surface the offset weight of the cleaning head typically causes the cleaning head to twist around the rotatable joint. The uncontrolled twisting of the cleaning head can be awkward and cumbersome for the user, especially when cleaning areas such as stairs where the cleaning head is repeatedly and frequently lifted from the surface.

SUMMARY OF THE INVENTION

The present inventors seek to reduce or avoid the above-stated problems and thereby improve the cleaning experience for the user. In particular, the inventors seek to increase the stability of a vacuum cleaner during periods of non-use and to minimise the uncontrolled twisting movement of the cleaning head when it is lifted from the surface being cleaned.

According to a first aspect of the invention there is provided a cleaning head for a vacuum cleaner, the cleaning head having a steering joint, the steering joint having a non-rotatable section and a rotatable section with a rotatable joint between the non-rotatable section and the rotatable section, the cleaning head having a first holding region which is engageable by a first part of the rotatable section, the first holding region and the first part of the rotatable section cooperating to resist relative rotation of the rotatable section, the cleaning head having a second holding region which is engageable by a second part of the rotatable section, the second holding region and the second part of the rotatable section cooperating to resist relative rotation of the rotatable section.

Preferably, the first part and the second part are spaced apart on the rotatable section. In such embodiments, the engagement of the first part of the rotatable section with the first holding region, and the engagement of the second part of the rotatable section with the second holding region, can be totally independent. This avoids any requirement to re-orient the rotatable section relative to the cleaning head dependent upon whether the first part and first holding region are to interengage, or the second part and second holding region are to interengage.

The first holding region and the first part can be configured similarly to known cleaning heads for securing the cleaning head relative to the rotatable portion in a first or storage position. The second holding region and the second part are, however, additional and serve to resist (and preferably prevent) relative rotation when the cleaning head is in a second position (the second position being separate from the first position).

The steering joint includes a pivotable joint. Preferably, the non-rotatable section provides a part of the pivotable joint. Preferably also, the rotatable portion has an upper part and a lower part, the upper part being bent or angled relative to the lower part.

The rotatable portion and the non-rotatable portion of the steering joint are preferably tubular, and provide parts of the conduit through which dirt and debris pass from the cleaning head to the dirt-collection chamber.

Preferably, the pivotable joint is located to the rear of the cleaning head, and in particular to the rear of the centre of gravity of the cleaning head. Such an arrangement causes the cleaning head to pivot downwardly under the influence of gravity relative to the rigid tube when the cleaning head is lifted. It is preferably arranged that the downwards pivoting movement of the cleaning head brings the second part and the second holding region into engagement. The interengagement can therefore be automatic each time the cleaning head is lifted. The automatic interengagement, and the resulting resistance to relative twisting movement, significantly reduces the awkwardness of use for the user.

The first holding region and the first part, and/or the second holding region and the second part, can cooperate by way of frictional engagement, and/or by a physical detent mechanism (for example one or more interengaging teeth).

Desirably, the first part and the second part are respective parts of a collar of the rotatable section, the collar preferably being continuous. Rotation of the rotatable section relative to the non-rotatable section is therefore resisted or prevented when desired by the interengagement of the collar and the first or second holding region.

In common with the known steering joints, the upper part of the rotatable section is typically aligned with (or alignable with) the rigid tube. Also in common with the known steering joints, the pivot axis of the pivotable joint is substantially parallel with the leading end of the cleaning head and is substantially horizontal in the normal orientation of use. It is a feature of the present invention that the pivot axis can retain its substantially horizontal orientation when the cleaning head is lifted, whereby the cleaning head can readily be replaced upon the surface (or another surface) to be cleaned.

Preferably, the rotatable section extends beyond the rotatable joint, i.e. rather than terminating at the rotatable joint. Desirably the rotatable section has a sleeve which surrounds a part of the non-rotatable section. Desirably also the collar is located at the end of the sleeve. Such arrangements allow the first part and the second part of the rotatable section to lie adjacent to the housing of the cleaning head and to more easily engage first and second holding regions provided by respective parts of the housing. Also, such arrangements allow the collar to be between the rotatable joint and the pivot axis of the pivotable joint.

Desirably, the first holding region and the second holding region are respective parts of the body of the cleaning head. Preferably the first holding region is a part of a housing part forming the top of the cleaning head and the second holding region is a part of a housing part forming the bottom of the cleaning head.

According to a second aspect of the invention there is provided a cleaning head for a vacuum cleaner, the cleaning head including a steering joint, the steering joint including a rotatable joint comprising a non-rotatable section and a rotatable section, the rotatable section having a collar which is engageable with a recess of the cleaning head, the recess and the collar being engageable to resist rotation of the rotatable section relative to the non-rotatable section when the cleaning head is in a storage condition.

The invention according to this second aspect does not share the feature of the second holding region and second part of the rotatable section which together maintain the orientation of the cleaning head when lifted away from a surface being cleaned. Instead, the second aspect is directed to the form of the cleaning head to resist unwanted rotation of the steering joint which is particularly beneficial during periods of non-use (either long-term or short-term).

As above explained, when the cleaning head is not in use the steering joint makes the vacuum cleaner unstable and it is desirable that the vacuum cleaner is made sufficiently stable so that it does not fall down during periods of non-use. It is not necessary that the steering joint is locked in order to stabilise the vacuum cleaner, but some means of resisting unwanted rotation of the steering joint is beneficial. The inventors have realised that the instability of the vacuum cleaner is largely due to the rotatable joint and reducing or preventing relative rotation during storage can significantly increase the stability of the vacuum cleaner. In particular, by reducing or preventing rotation of the rotatable section the present inventors take advantage of the relative stability offered by the (large-area) cleaning head resting upon the floor.

Preferably, the recess is formed in the top wall of the body of the cleaning head. Preferably also there is frictional engagement between the recess and the collar. The interengagement of the collar and recess can be automatic, with the collar engaging the recess as soon as the rotatable section is moved into its storage position relative to the cleaning head.

It is not necessary that the recess and collar interengage sufficiently to lock the rotatable section in position relative to the non-rotatable section; instead for this aspect of the invention it is desired to resist relative rotation at the steering joint sufficiently to stabilise the rotatable section during periods of non-use.

The steering joint also includes a pivotable joint; desirably the non-rotatable section provides a part of the pivotable joint. Desirably also, the cleaning head has a sole plate which in use is parallel with the surface being cleaned. Preferably, the non-rotatable section is pivotable about a pivot axis which is substantially parallel with the sole plate.

Preferably, the rotatable section extends beyond the rotatable joint, i.e. rather than terminating at the rotatable joint. Desirably the rotatable section has a sleeve which surrounds a part of the non-rotatable section. Desirably also the collar is located at the end of the sleeve. Preferably the collar is located between the rotatable joint and the pivot axis.

In preferred embodiments of both aspects of the invention the steering joint is an integral part of the cleaning head but it is envisaged that in some embodiments some or all of the components of the steering joint may be removable from the cleaning head.

Preferable and desirable features of one aspect of the invention may be utilised with the other aspect of the invention for which they are suitable.

BRIEF DESCRIPTION OF THE PREFERRED EMBODIMENTS

The invention will now be described in more detail, by way of example, with reference to the accompanying drawings, in which:

FIG. 4 shows a perspective view of the cleaning head of the stick vacuum cleaner of FIG. 1;

FIG. 5 shows a side view of the cleaning head of FIG. 4 with the rotatable section of the steering joint shown in dotted outline in three of its available pivoted positions relative to the cleaning head;

FIG. 6 shows a plan view of the cleaning head of FIG. 4 with the rotatable section shown in dotted outline in two of its available rotated positions relative to the cleaning head;

DETAILED DESCRIPTION

Figure 1:
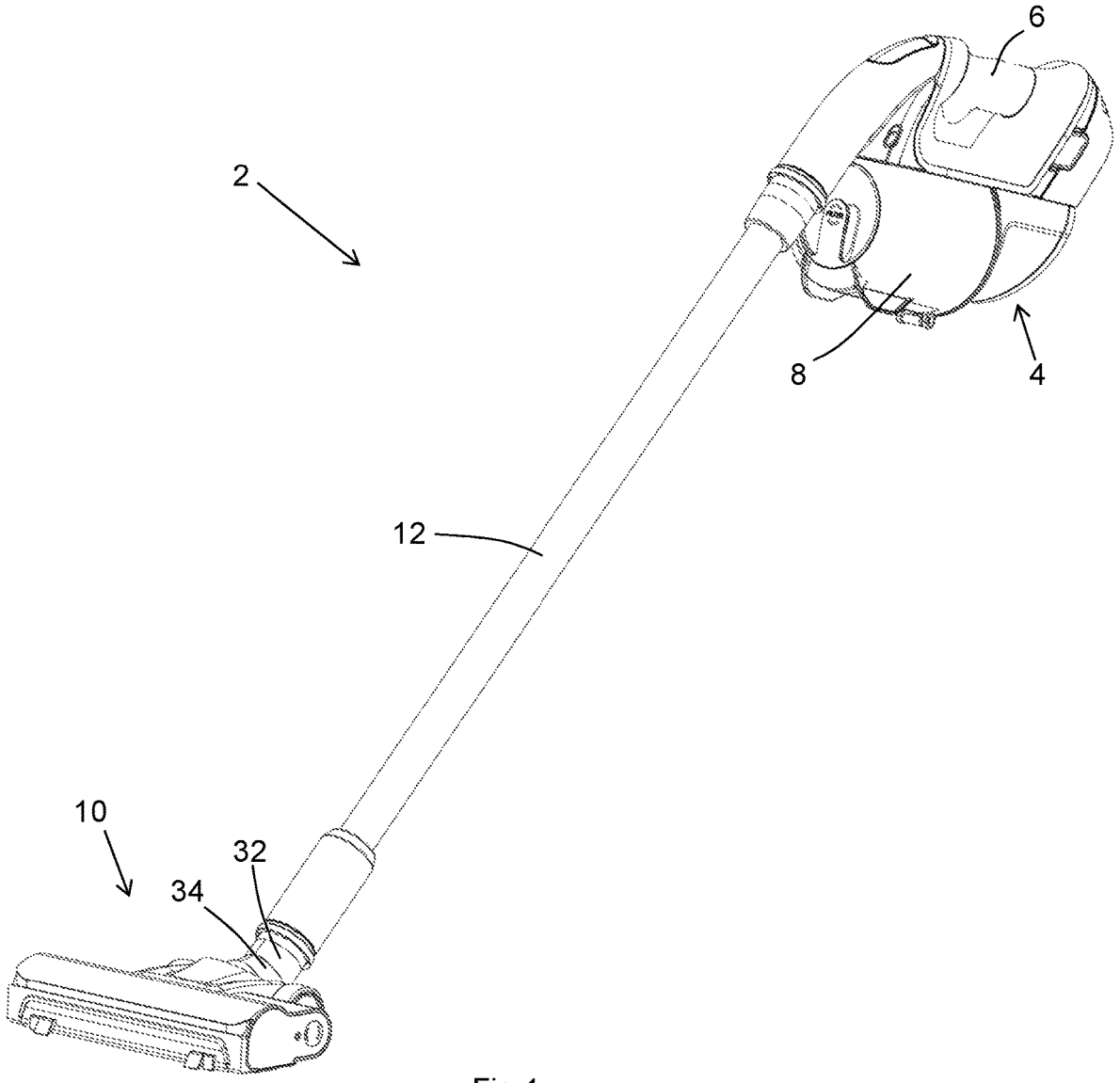
FIG. 1 shows a perspective view of a stick vacuum cleaner in a position of use, the stick vacuum cleaner having a cleaning head according to the present invention.

The stick vacuum cleaner 2 comprises a body 4 with a handle 6 for gripping by the user. The body typically contains a battery, a motor, an impeller (not seen) and a dirt-collection chamber 8. The body 4 is connected to a cleaning head 10 by a (substantially) rigid tube 12, the tube 12 being sufficiently long to permit (for example) the cleaning head to be used for floor cleaning whilst the user is standing and carrying the body 4. In known fashion, the rigid tube 12 and cleaning head 10 are typically removable from the body 4 to enable other cleaning operations.

As shown in FIG. 4, the cleaning head 10 has a connection portion 14. The connection portion 14 permits the cleaning head 10 to be releasably connected to the rigid tube 12. In a stick vacuum cleaner it may not be necessary or desirable for the user to be able to separate the cleaning head 10 from the rigid tube 12 and in such cases the rigid tube 12 may be permanently connected to the connection portion 14. In a cylinder vacuum cleaner on the other hand, it may be desirable for the rigid tube 12 to be permanently connected to the flexible hose (not shown) in which case the user can remove the cleaning head 10 when desired by separating the rigid tube 12 from the connection portion 14.

In other embodiments rigid tube 12 may be extendable (telescopically) in known fashion.

Figure 8:
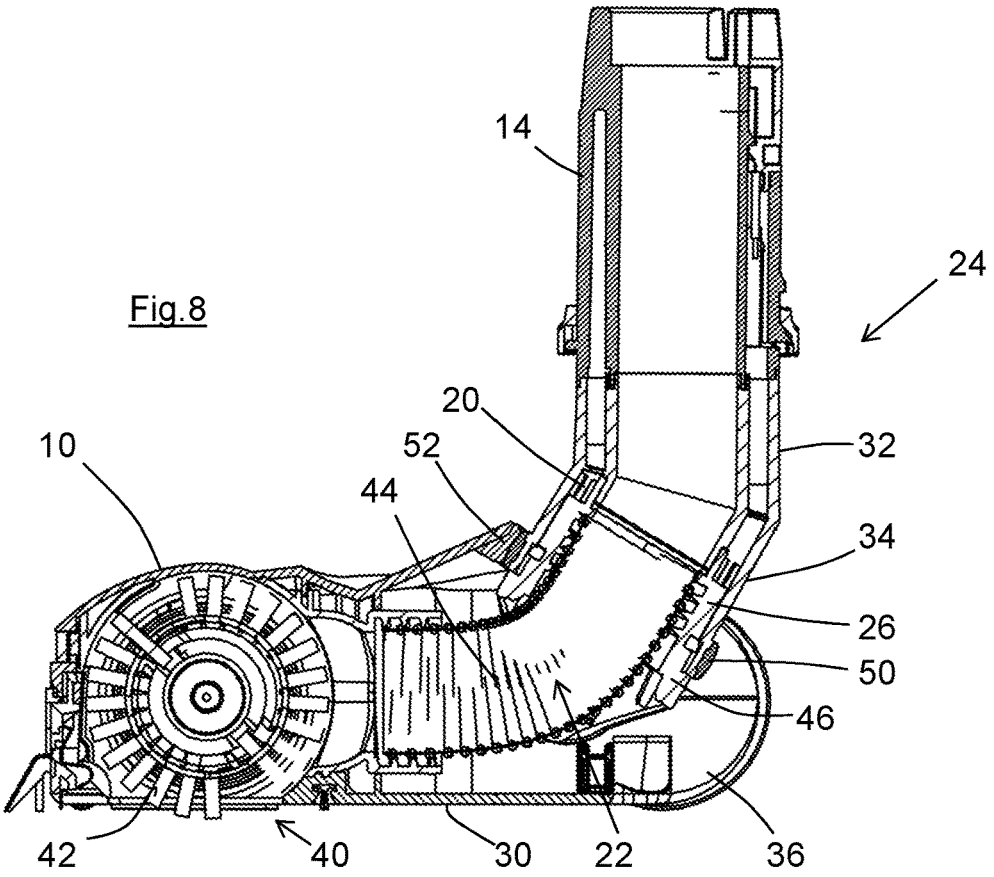
FIG. 8 shows a cross-section through the cleaning head in the storage position of FIG. 7.

The cleaning head 10 has a steering joint comprising a rotatable joint 20 and a pivotable joint 22 (see FIG. 8). The rotatable joint 20 comprises a rotatable section 24 and a non-rotatable section 26. The rotatable section 24 includes the connection portion 14 and can therefore rotate (twist) with the rigid tube 12 and body 4 of the vacuum cleaner 2, in known fashion. The rotatable section 24 is connected to, and is rotatable relative to, the non-rotatable section 26 by way of the rotatable joint 20. The exact form of the rotatable joint between the rotatable section 24 and the non-rotatable section 26 is not relevant to the present invention. The rotatable joint 20 may permit 360° of rotation, or less than 360°, as desired.

The non-rotatable section 26 is pivotably mounted to the remainder of the cleaning head 10 by way of a pivotable joint 22. Again, the detail of the pivotable joint is not relevant to the present invention.

The pivotable joint 22 permits a significant pivoting range for the non-rotatable section 26, and consequently also for the rotatable section 24 (and for a connected rigid tube 12), as shown in FIG. 5. Specifically, the rotatable section 24 can pivot between a first (storage or upright) position in which the axis A-A of the connection portion 14 is substantially vertical as shown in position I, and two operational positions II and III.

The rotatable joint 20 permits a significant rotational range for the rotatable section 24 (and for a connected rigid tube 12), as shown in FIG. 6. Specifically, the rotatable section 24 can rotate between the two operational positions IV and V. It will be seen from FIGS. 7 and 8 in particular that the rotatable section 24 comprises an upper part 32 and a lower part 34, the upper part 32 being bent or angled relative to the lower part 34. Rotation of the connection portion 14 clockwise about its axis A-A therefore causes the connection portion to move from the position V to the position IV, and vice versa (the relative rotation being most clearly visible from the different relative position of the tube connector 18 in the positions IV and V.

It will be understood that in common with many prior art vacuum cleaners, the rigid tube 12 is substantially linear, the axis of the (fitted) tube being substantially parallel to the axis A-A of the connection portion 14. It will also be understood that the cleaning head 10 is steered by way of the user rotating or twisting the body 4 by way of the handle 6, and thereby twisting the rigid tube 12 about its longitudinal axis, which in turn rotates the rotatable section 24 about the axis A-A. As the rotatable section 24 is rotated, the cleaning head 10 pivots about the pivotable joint 22 as required to maintain the sole plate 30 of the cleaning head 10 in contact with the surface being cleaned.

Thus, contrary to the representation of FIG. 6, in practice the connection portion 14 will be held in substantially the same place by the user and twisting movement around the axis A-A will cause the direction of the wheels 36 of the cleaning head 10 to change as desired.

As shown in the sectional view of FIG. 8, in common with many cleaning heads the sole plate 30 has an opening 40 at its leading end. A brush 42 projects through the opening, the brush being engageable with the carpet or other floor surface (not shown). The opening 40 is connected to a chamber within the cleaning head 10 which is in turn connected to a short length of flexible hose 44 within the cleaning head, the flexible hose 44 in this embodiment terminating adjacent to the rotatable joint 20. The flexible hose 44 helps to ensure leak-free airflow through the cleaning head 10 despite the rotation and pivoting movements of the steering joint.

The brush 42 is rotated by a motor which is not seen but which is located in portion 46 of the cleaning head 10. Importantly, the motor is located away from the centreline of the cleaning head so that it does not impede the flexible hose 44 nor therefore obstruct the airflow through the cleaning head. The motor is the heaviest component of the cleaning head and its offset location causes the weight of the cleaning head 10 also to be offset. In particular, the weight of the cleaning head is offset from the rotation axis A-A. As above indicated, therefore, absent the present invention, when the cleaning head 10 is lifted from the surface being cleaned so that it is suspended by way of the rigid tube 12, the offset weight causes the cleaning head to twist uncontrolledly around the rotation axis A-A, which is awkward for the user and makes the known cleaning heads cumbersome to use.

Figure 7:
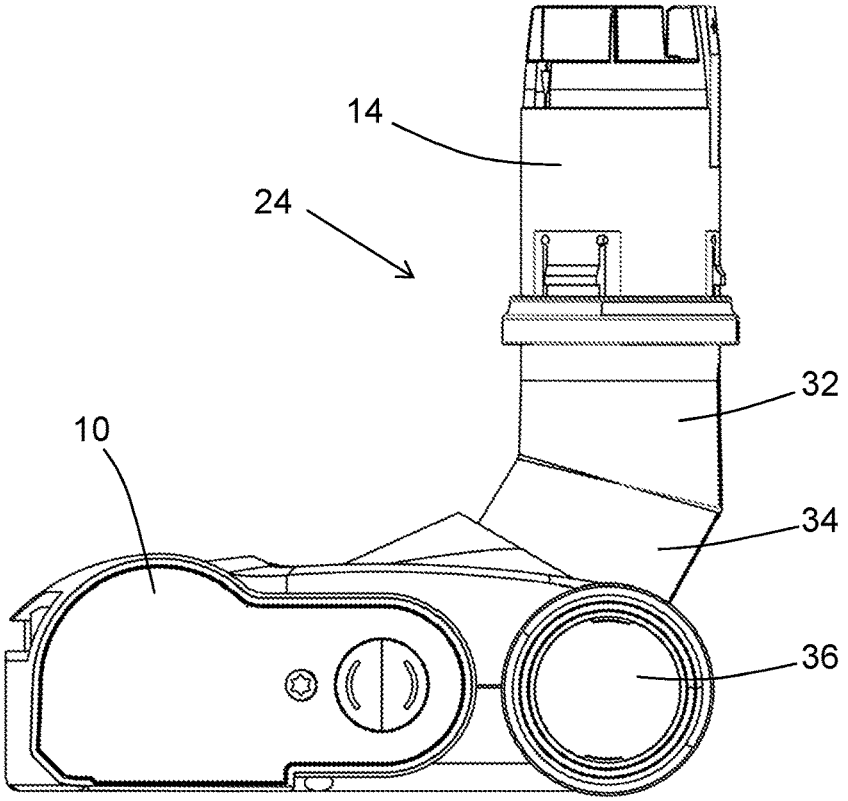
FIG. 7 shows a side view of the cleaning head with the rotatable section in its storage or upright position.

More detail of the steering joint 20 is seen in FIG. 8. The non-rotatable section 26 of the steering joint accommodates the flexible hose 44 and terminates at a bottom end 46. Though not shown in the drawings, the bottom end 46 is mounted to pivot relative to the body of the cleaning head 10, about a substantially horizontal pivot axis, providing the pivotable joint 22. The pivoting connection prevents rotation of the bottom end 46 about its longitudinal axis, and the bottom end 46, and remainder of the non-rotatable part 26, is restricted to pivoting movement between its various positions including the storage position I (as also shown in FIGS. 7 and 8) and the operational positions II and Ill.

The non-rotatable section 26 is tubular and extends into the interior of the tubular lower part 34. Thus, the rotatable section 24 does not terminate at the rotatable joint 20 but continues (in the direction towards the sole plate 30) past the rotatable joint 20. Specifically, the lower part 34 includes a sleeve which surrounds a part of the non-rotatable section 26 as shown. The detailed construction of the rotatable joint 20 is not shown and is not relevant to the present invention, except to state that the lower part 34, the upper part 32 which is connected thereto, and the connection portion 14, can all rotate relative to the non-rotatable part 26 around the rotatable joint 20.

The (rotatable) lower part 34 terminates at an annular collar 50 which has a covering of a high-friction material such as rubber. It will be understood that extending the non-rotatable section 24 past the rotatable joint 20 has the benefit of moving the collar 50 towards the body of the cleaning head 10, facilitating the anti-rotation features as explained below.

The top wall of the body of the cleaning head 10 has a first holding region 52 which is shaped to accommodate the collar 50. As seen in FIG. 8, in the first or storage position of the rigid tube 12 a first part of the collar 50 engages the first holding region 52. This engagement, and the relative friction between the first part of the collar 50 and the first holding region 52, is sufficient to resist rotation of the rotatable section 24 (and the connected rigid tube 12) relative to the body of the cleaning head 10, so that in the storage position the cleaning head is substantially locked in position.

Figure 3:
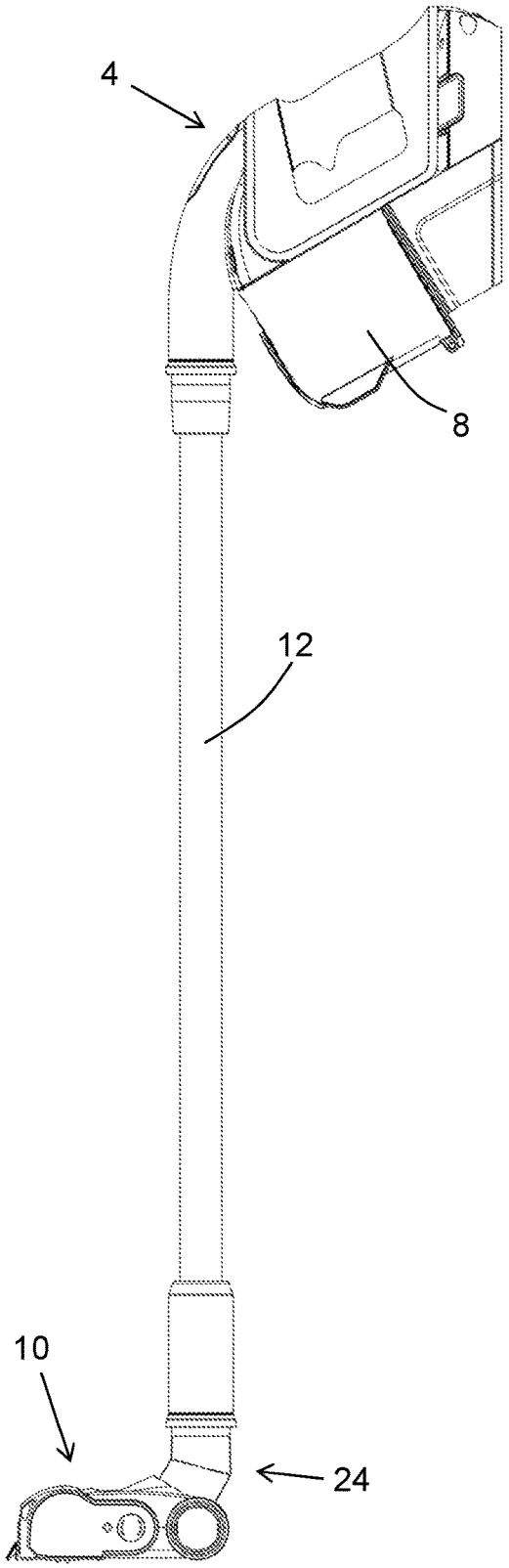
FIG. 3 shows a side view of the stick vacuum cleaner in its storage position.
Figure 2:
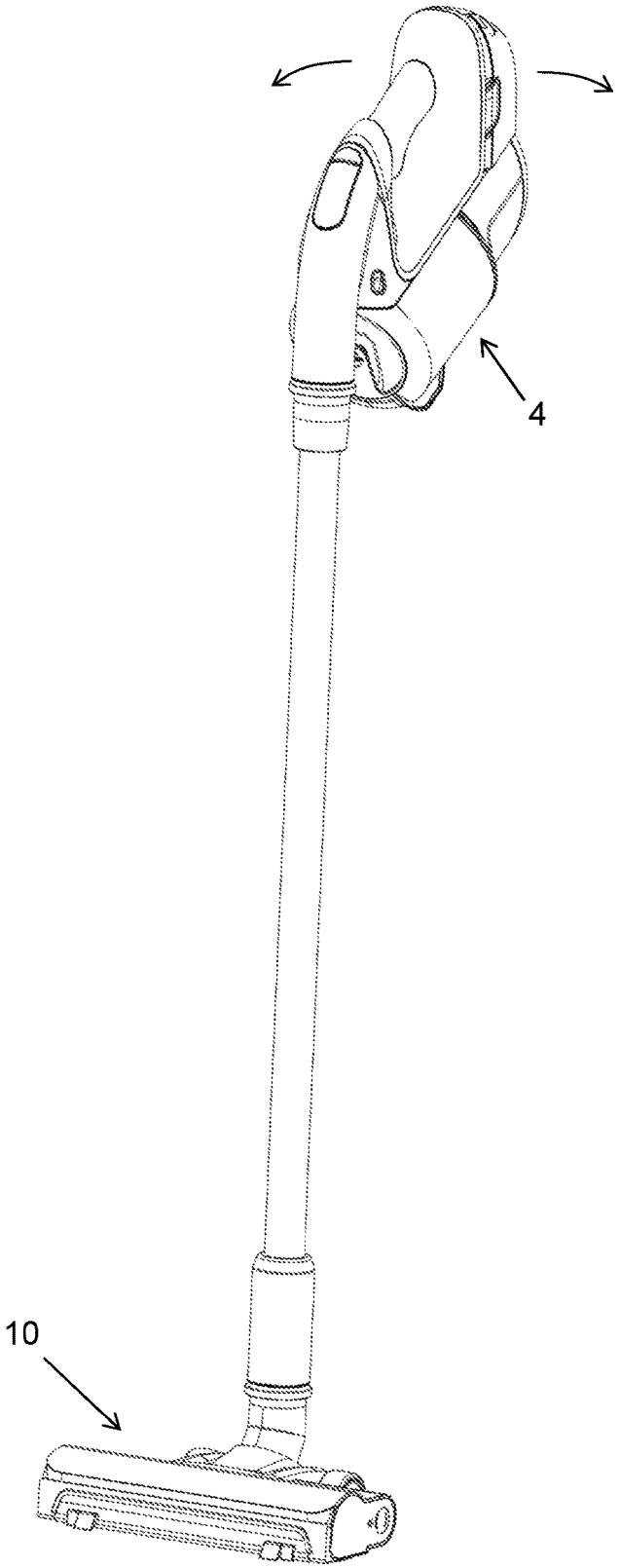
FIG. 2 shows a perspective view of the stick vacuum cleaner of FIG. 1 in a storage position.

The storage position I is also shown in FIGS. 2 and 3. It will be understood that in a conventional stick vacuum cleaner the steering joint allows the rigid tube 12 to rotate (clockwise and anticlockwise) as viewed relative to the cleaning head. During periods of non-use the vacuum cleaner is typically stored with the body 4 resting against a wall. The user must take care to ensure that the body 4 is balanced so that it does not slide across and down the wall as indicated by the curved arrows in FIG. 2.

With the present invention on the other hand, the interengagement of the first part of the collar 50 and the first holding region 52 resist rotation of the steering joint 20. The effect of this is that the cleaning head 10 rotates with the connection portion 14 so that if the body 4 of the vacuum cleaner slides across and down the wall as indicated by the curved arrows in FIG. 2, the cleaning head 10 will tip over relative to the floor. The large area of the cleaning head 10 in engagement with the floor provides a large base to resist the tendency of the cleaning head 10 to tip over so that the stability of the vacuum cleaner 2 in its storage position is significantly increased.

It will be understood that the collar 50 automatically engages the recess 52 when the steering joint is pivoted to its storage position, so that the rotatable section 24 becomes automatically secured against relative rotation. It will be appreciated by those skilled in the art that the automatic retention of the rotatable section 24, or alternatively stated the automatic locking of the steering joint, has significant practical benefits, especially during short-term periods of non-use when a user may be less diligent in ensuring that the stick vacuum cleaner is properly balanced. Accordingly, the second aspect of the invention is directed to this feature and the described structure of the cleaning head 10.

Figure 11:
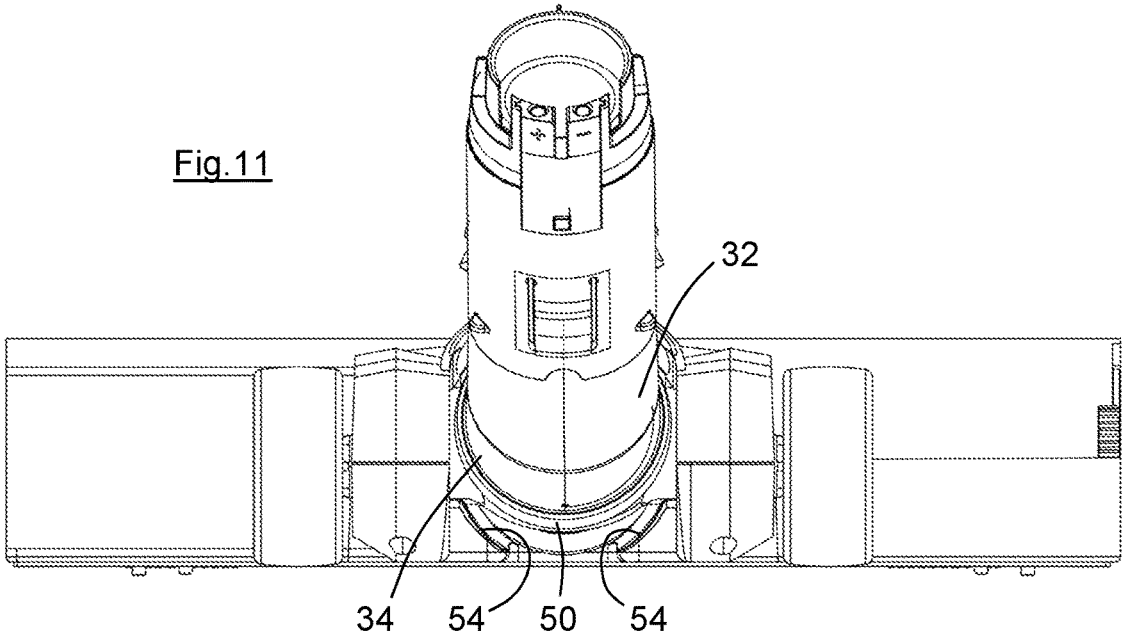
FIG. 11 shows a rear view of the cleaning head in another operating position.

According to the first aspect of the invention, on the other hand, the cleaning head 10 provides additional benefits. As seen in FIG. 11, the bottom wall of the body of the cleaning head 10 has two second holding regions 54. The second holding regions 54 are both part-circular (as is the first holding region 52), but in other embodiments comprises a number of discrete linear surfaces.

FIG. 11 represents the cleaning head in the operating position II shown in FIG. 5. It will be understood that whilst relative rotation around the rotatable joint 20 is resisted or prevented in the storage position I of FIG. 5, the rotatable joint can rotate in both of the operational positions II and III so that the cleaning head 10 can be steered in both of those operational positions (and in all other operational positions between the positions I and II and between the positions II and III).

Accordingly, as seen in FIG. 11, the collar 50 is spaced from the second holding regions 54, and (since it is also spaced from the first holding region 52) relative rotation of the collar 50 (and thereby the rotatable section 24) is not resisted or prevented in that operational position.

The operational position III shown in FIG. 5 seeks to represent the (clockwise) limit of the operational positions, i.e. the limit at which the cleaning head 10 can be steered. In that operational position, the gap between the collar 50 and the second holding regions 54 is very small, but relative rotation of the collar 50 is nevertheless not resisted or prevented.

Figure 9:
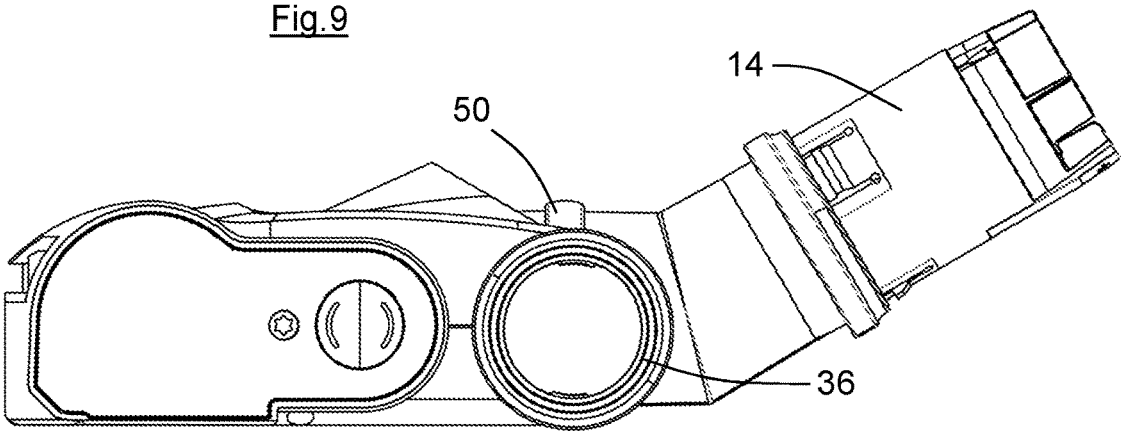
FIG. 9 shows a side view of the cleaning head with the rotatable section in an operating position.
Figure 10:
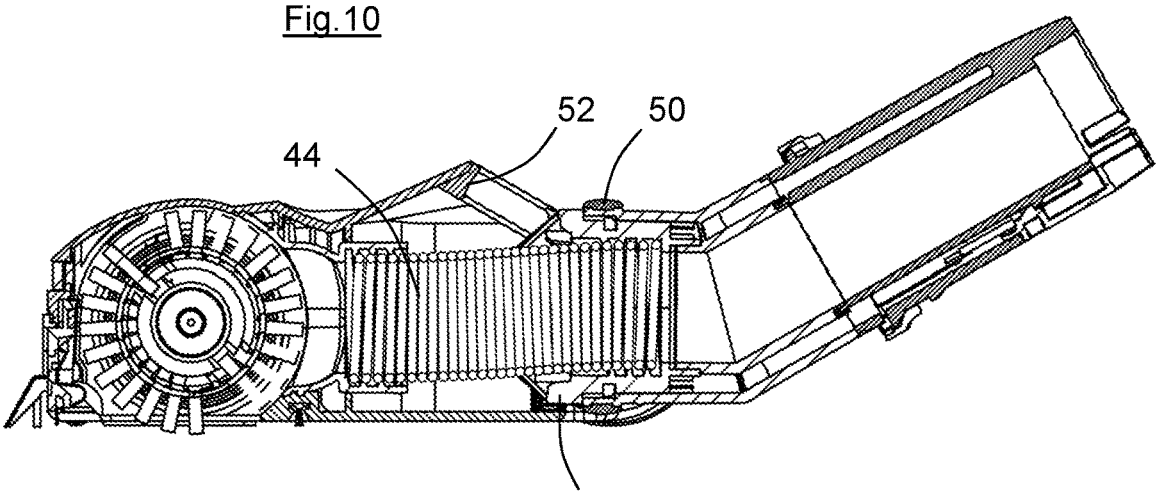
FIG. 10 shows a cross-section through the cleaning head in the operating position of FIG. 8.
Figure 12:
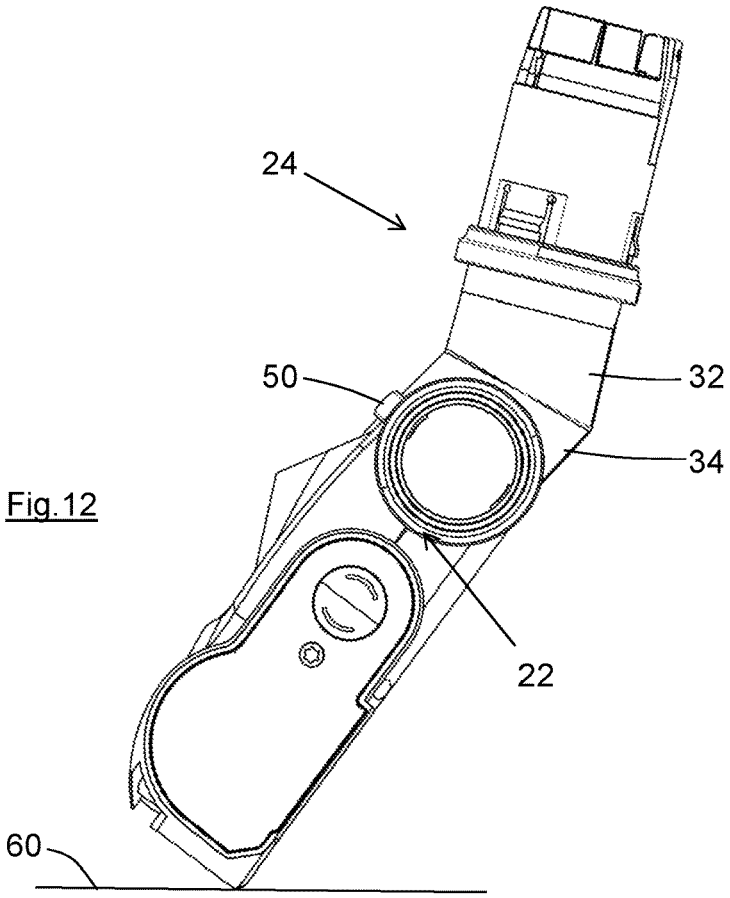
FIG. 12 shows a side view of the cleaning head in a position in which it is lifted from the surface.
Figure 13:
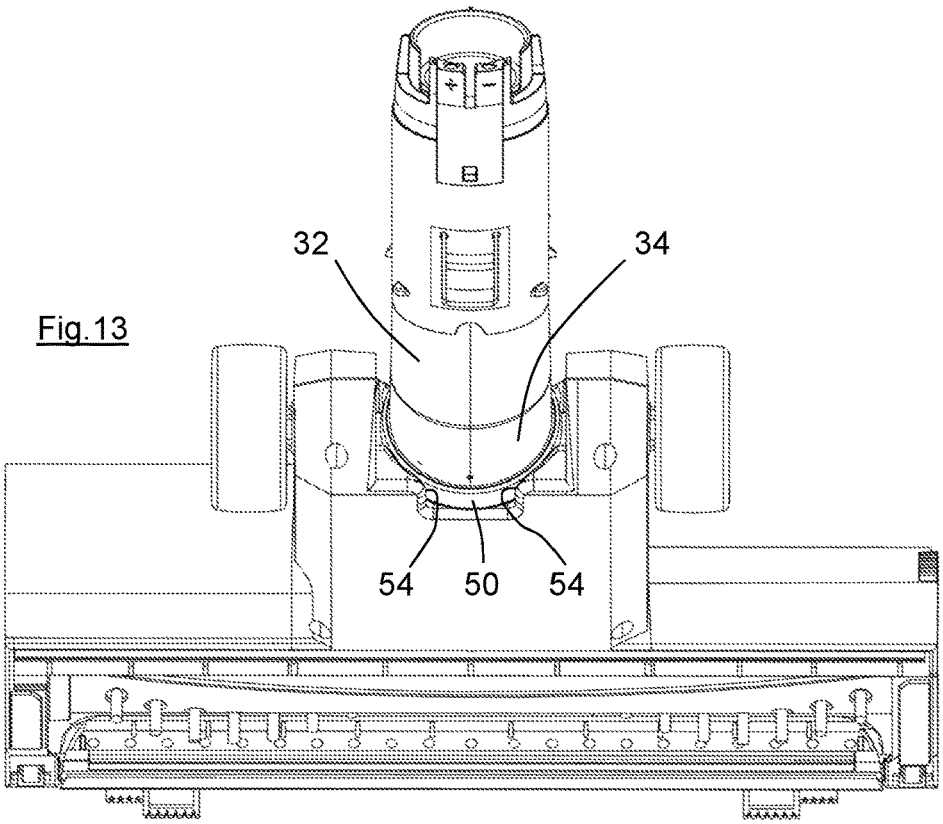
FIG. 13 shows a rear view of the cleaning head in the position of FIG. 12.

The rotatable section 24 can, however, pivot slightly beyond the operational position III to a second position shown in FIGS. 12 and 13 (a comparison of FIGS. 9 and 12 will show that the rotatable section 24 is pivoted slightly further clockwise relative to the body of the cleaning head 10 in FIG. 12).

It will be understood that the pivotable joint 22 is offset from the centre of gravity of the cleaning head, and in particular the centre of gravity is between the leading end 56 of the cleaning head 10 and the pivotable joint 22. Accordingly, and in common with known cleaning heads, when the cleaning head 10 is lifted away from the surface 60 being cleaned it drops or pivots downwardly about the pivotable joint 22 as represented in FIG. 12. Before the cleaning head 10 leaves the surface 60 it pivots beyond the operational position III and into the second position of FIGS. 12 and 13. In that second (or lifted) position, the collar 50 engages the second holding regions 54 as seen in FIG. 13.

Once again, the interengagement is automatic and the relative friction between the second part of the collar 50 and the second holding regions 54 is sufficient to prevent inadvertent rotational movement of the rotatable section 24 relative to the cleaning head 10, so that in the lifted position the cleaning head 10 is substantially locked in position.

During use of the cleaning head 10, the rotatable section 24 will be in an operational position (such as the operational position II or Ill) in which the collar 50 is substantially free to rotate relative to the non-rotatable part 26 and the cleaning tool 10 can be steered in known fashion. As the cleaning head 10 is lifted from the surface 60, however, the weight of the cleaning head will cause it to pivot (anti-clockwise as viewed in FIG. 9) about its pivotable joint 22 until it reaches the position of FIG. 12. FIG. 12 represents the position immediately before the cleaning head 10 leaves the surface 60 and it will be understood that the interengagement between the second part of the collar 50 and the second holding regions 54 in that position prevent unwanted rotation of the cleaning head 10 relative to the rigid tube 12. That interengagement is maintained, and unwanted rotation is prevented, whilst the cleaning head is suspended by way of the rigid tube 12.

Importantly, it will be understood that the pivot axis of the pivotable joint 22 is maintained substantially horizontal in the positions of FIGS. 9 and 12 and since unwanted rotation is resisted when the cleaning head 10 is subsequently lifted from the surface 60 that horizontal orientation is maintained. The user can therefore readily replace the cleaning head onto the surface 60, or onto another surface to be cleaned, without needing to reorient or re-rotate the cleaning head.

When cleaning stairs for example in which it is necessary to repeatedly lift the cleaning head 10 from the surface 60, the horizontal orientation of the pivot axis, and thereby the rotational orientation of the cleaning head 10, can be maintained as the cleaning head is moved from one stair to the next, and the user is not required to re-rotate the cleaning head each time it is placed onto a new stair.

Though not shown in the drawings, the first holding region (and if desired also the second holding region) can include a detent mechanism so that the cleaning head is made more secure when it its storage (and if desired also its lifted) positions.

In alternative embodiments the interengagement between the first holding region and the first part and/or the interengagement between the second holding region and the second part, do not rely upon friction. Instead, the cooperating parts carry a number of interlocking teeth or projections providing a mechanical interconnection to resist relative rotation in the storage and lifted positions.

It will be understood that it is not necessary for the collar 50 to be continuous in order to provide the first and second parts for engaging the first and second holding regions. It is similarly not necessary that the sleeve of the lower part 34 is annular. Embodiments in which the lower part 34 and the sleeve are annular and in which the collar 50 is continuous are, however, preferred.

The invention claimed is:

1. A cleaning head (10) for a vacuum cleaner (2), the cleaning head having a steering joint comprising a rotatable joint (20) and a pivotable joint (22), the rotatable joint (20) having a non-rotatable section (26) and a rotatable section (24) with the rotatable joint (20) between the non-rotatable section and the rotatable section, the cleaning head having a first holding region (52) which is engageable by a first part (50) of the rotatable section (24), the first holding region and the first part of the rotatable section when engaged resisting rotation of the rotatable section, the cleaning head having a second holding region (54) which is engageable by a second part (50) of the rotatable section (24), the second holding region and the second part of the rotatable section when engaged resisting rotation of the rotatable section, the pivotable joint (22) enabling the rotatable section (24) to pivot between a first pivoted position (I) and a second pivoted position relative to the remainder of the cleaning head, the first part of the rotatable section engaging the first holding region (52) in the first pivoted position, and the second part of the rotatable section engaging the second holding region (54) in the second pivoted position.

2. The cleaning head (10) according to claim 1 in which the first part of the rotatable section and the second part of the rotatable section are spaced apart on the rotatable section (24).

3. The cleaning head (10) according to claim 1 in which the non-rotatable section (26) provides a part of the pivotable joint (22).

4. The cleaning head (10) according to claim 1 having a leading end (56), a trailing end, and a centre of gravity between the leading and trailing ends, in which the pivotable joint (22) is located between the centre of gravity and the trailing end.

5. The cleaning head (10) according to claim 1 in which, in use, upwards pivoting movement of the rotatable section (24) brings the first part (50) of the rotatable section and the first holding region (52) into engagement.

6. The cleaning head (10) according to claim 1 in which, in use, downwards pivoting movement of the rotatable section (24) brings the second part (50) of the rotatable section and the second holding region (52) into engagement.

7. The cleaning head (10) according to claim 1 having a sole plate (30), the rotatable section (24) having a connection portion (14) with a longitudinal axis (A-A), the first part (50) of the rotatable section and the first holding region (52) engaging when the longitudinal axis (A-A) is substantially perpendicular to the sole plate (30).

8. The cleaning head (10) according to claim 1 in which the rotatable section (24) has an upper part (32) and a lower part (34), the upper part being angled relative to the lower part.

9. The cleaning head (10) according to claim 1 in which the rotatable section (24) and the non-rotatable section (26) are tubular, and provide parts of a conduit through which dirt and debris can pass.

10. The cleaning head (10) according to claim 1 in which the first holding region (52) and the first part of the rotatable section and/or the second holding region (54) and the second part of the rotatable section cooperate by way of frictional engagement.

11. The cleaning head (10) according to claim 10 in which the first part of the rotatable section is curved, in which the first holding region (52) is curved to match the curvature of the first part of the rotatable section, in which the second part of the rotatable section is curved, and in which the second holding region (54) is curved to match the curvature of the second part of the rotatable section.

12. The cleaning head (10) according to claim 1 in which the first part of the rotatable section and the second part of the rotatable section are respective parts of a collar (50) of the rotatable section (24).

13. The cleaning head (10) according to claim 12 in which the collar (50) is located at the end of a sleeve of the rotatable section (24).

14. The cleaning head (10) according to claim 13 in which the sleeve surrounds a part of the non-rotatable section (26).

15. The cleaning head (10) according to claim 13 or claim in which the sleeve surrounds the rotatable joint (20).

16. The cleaning head (10) according to claim 12 in which the collar (50) is located between the rotatable joint (20) and the pivot axis of the pivotable joint (22).

17. The cleaning head (10) according to claim 1 in which the first holding region (52) and the second holding region (54) are respective parts of the body of the cleaning head (10).

18. The cleaning head (10) according to claim 17 in which the first holding region (52) is provided by a housing component forming a part of the top of the cleaning head (10).

19. The cleaning head (10) according to claim 17 in which the second holding region (54) is provided by a housing component forming a part of the bottom of the cleaning head (10).

* * * * *